United States Patent [19]

Senter

[11] 4,050,167

[45] Sept. 27, 1977

[54] ARTICLE OF FOOTWEAR WITH A THREE-DIMENSION INSET FIGURE IN ITS RECESSED SOLE AND METHOD OF MAKING THE SAME

[76] Inventor: Jonas Senter, 910 Fifth Ave., New York, N.Y. 10011

[21] Appl. No.: 662,929

[22] Filed: Mar. 1, 1976

[51] Int. Cl.[2] ..... A43B 13/04; A43B 23/28; A43B 3/28

[52] U.S. Cl. ..... 36/32 R; D2/321; 36/112; 36/59 R

[58] Field of Search ..... 36/1, 25, 32 R, 4, 7.3, 36/87, 103, 104, 112; D2/279, 281, 321

[56] References Cited

U.S. PATENT DOCUMENTS

| | | | |
|---|---|---|---|
| 3,494,055 | 2/1970 | McSorley | 36/59 R |
| 3,906,642 | 9/1975 | Cohen | 36/112 |
| D. 72,474 | 4/1927 | Calvin | D2/321 |
| D. 80,217 | 12/1929 | Chrisfield | D2/321 |

OTHER PUBLICATIONS

T. J. Edwards Block Ad; American Shoemaking; p. 22, Feb. 9, 1977.

*Primary Examiner*—Patrick D. Lawson
*Attorney, Agent, or Firm*—Haseltine, Lake & Waters

[57] ABSTRACT

Article of footwear having a sole, an upper, and at least one recessed area in the sole, with a three-dimensional inset figure placed in the recessed area, having a matching overlay illustration on its exposed surface. The inset figure may be constituted by a representation and/or a text, and it may be at least partly embossed, the exposed surface being substantially flush with the walking surface of the sole. At least portions of the inset figure may be colored. The inset figure may be slightly smaller in its outlines than those of the recessed area of the sole, thereby presenting a set-off border to the inset figure. The inventive method for making the article of footwear comprises the steps of applying to a thin rubber sheet at least two of the representations and/or the text, by the application of heat; cutting out the individual representations from the sheet; placing at least one sole portion preform into a pressing mold, the preform having therein a substantially planar recess; applying the cut-out representations into the respective recesses so as not to protrude therefrom; molding the sole preform with the inserted representations so as to be permanently united, separately making the footwear, including an upper portion adapted to be combined with one of the sole portion preforms; and securing the sole preform to the upper of the footwear, the outer planar surfaces of the representations in the preform recess remaining substantially flush with the walking surface of the completed footwear.

1 Claim, 9 Drawing Figures

ARTICLE OF FOOTWEAR WITH A THREE-DIMENSION INSET FIGURE IN ITS RECESSED SOLE AND METHOD OF MAKING THE SAME

This invention relates to an article of footwear that has a three-dimensional inset figure and/or text in its recessed sole.

It is known in the prior art to provide decorations, embossed figures, serrations, and the like on and in the soles of footwear. While these expedients provide a better grip in walking, they may unnecessarily increase the height of the footwear, cause slippage, and may be objectionable for other reasons.

Examples of such prior art are U.S. Design Pat. Nos. 74,554, 112,429, 122,281, 166,472, and also utility Pat. Nos. 3,303,250 and 3,402,485.

It is a novel concept, according to this invention, to place a three-dimensional inset figure or such figures in a recessed area of the sole, so that the exposed surface thereof is substantially flush with the walking surface of the sole.

The new article of footwear is pleasing in its appearance, and it can also constitute an educational tool since figures (pictorial representations) can be combined with names, texts or words.

If the footwear is also provided with a foxing tape, any desired correlation can be had with the inset figure in the sole.

The inset figure of the footwear may be at least partly embossed and/or have a layer of matching illustration thereon. At least portions of the inset figure may also be colored.

According to a preferred, optional feature of the invention, the inset figure may be slightly smaller in its outlines than those of the recessed area of the sole, thereby presenting a set-off border to the inset figure(s).

According to a preferred method of making the novel articles of footwear, first a thin rubber sheet is provided with at least two insets or representations (figures and/or words) in a three-dimensional, integrally molded configuration, preferably by the use of heat. Then the individual representations are cut out from the sheet. At least one sole preform is then placed into a pressing mold, the preform having therein a substantially planar recess, of a size slightly larger than the outlines of the insets. Thereafter a number of the cut-out insets is applied into the respective recesses so as not to protrude therefrom; the sole portion preform is molded with the inserted representations so as to be permanently united. The footwear, including portions of an upper, is made separately, and then the sole preform is secured to the upper portion of the footwear, the outer planar surface of the inset in the preform recess remaining substantially flush with the walking surface of the completed footwear.

According to further, optional steps that can be practised according to the invention, the rubber sheet and the insets or representations themselves can be at least partly colored. A color overlay may also be used to form a complementary design. The representations on the surface of the rubber sheet may be at least partly embossed.

According to yet another optional feature, the sole portion preforms can be made with circumferential, reentrant border ridges that are separate from the planar recesses therein.

Reference may now be had to a preferred embodiment of the inventive footwear, taken in conjunction with the accompanying drawings, wherein.

Figure 1:
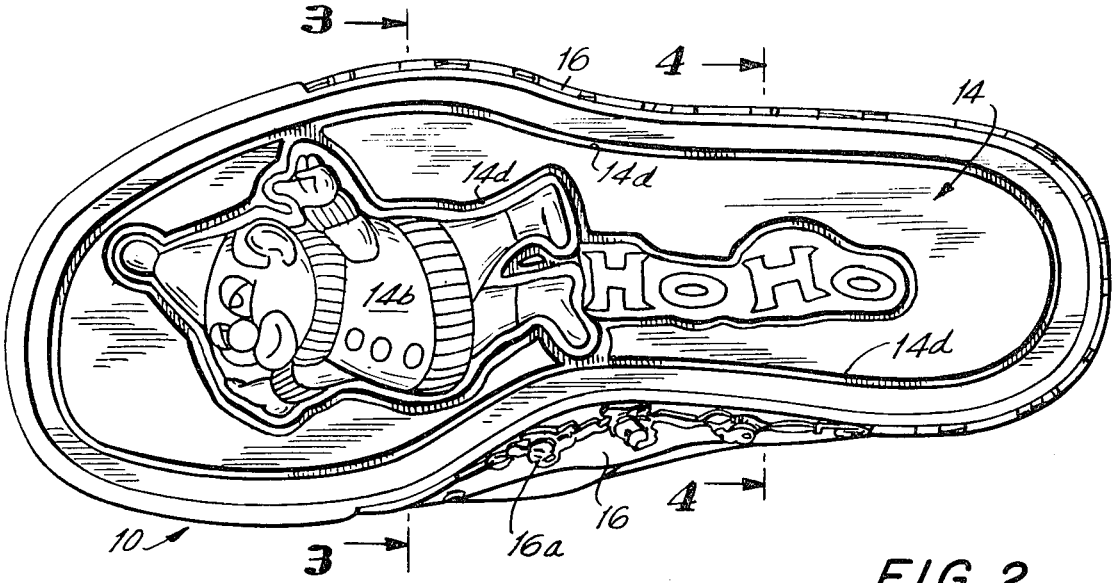
FIG. 1 is a plan elevation from below of the sole of an article of footwear, for example, a sport shoe or sneaker, incorporating the novel three-dimensional inset figure or representation in a recessed area.
Figure 3:
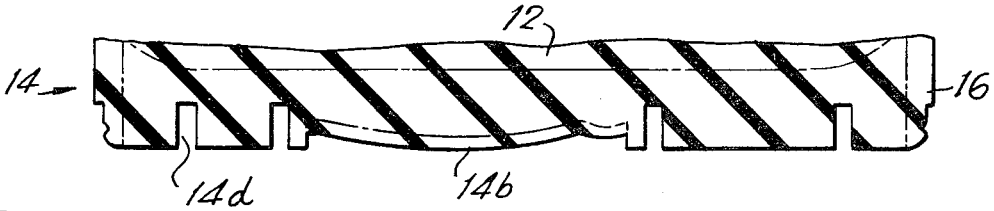
Figure 5:
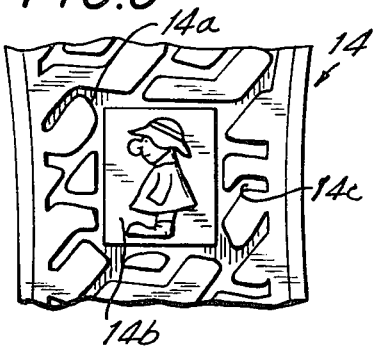
Figure 4:
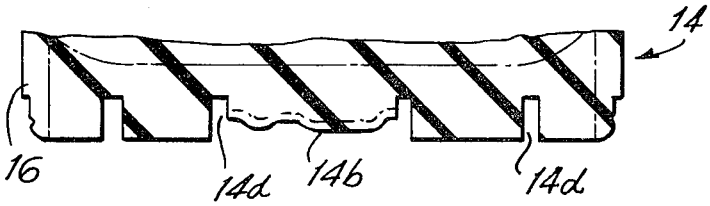

FIGS. 3 and 4 are transversal sectional views of the semi-assembled article, taken along respective lines 3—3 and 4—4 of FIG. 1;

FIG. 5 is a partial plan view of a sole (similar to that of FIG. 1 but taken at right angles thereto, on a smaller scale and parts being broken away); and FIGS. 6 through 9 show various operational phases during the manufacture of the inventive article of footwear.

Referring now in detail to the drawings, FIG. 1 illustrates an exemplary footwear, such as a sneaker or sport shoe 10 from below, having an upper 12 (of which only a portion is shown in the exploded view of FIG. 2 and a similar, small portion incorporated in the sectional views of FIGS. 3 and 4). A sole portion 14 has therein a substantially central, recessed area **14*a* into which at least one three-dimensional inset or representation 14*b*** is inserted during the manufacture.

Figure 2:
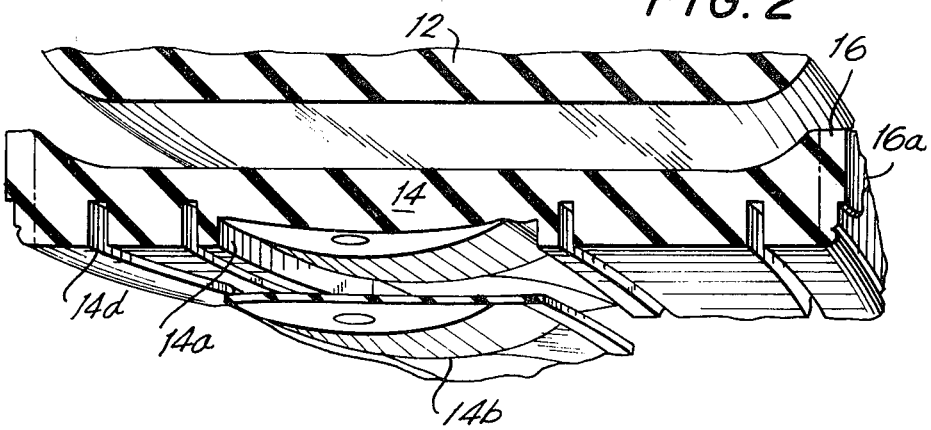
FIG. 2 is an exploded view showing a sole preform used for making the novel footwear with a cut-out representation or figure to be inserted in the recessed area of the preform, and a schematically shown upper portion of the footwear to which the preform is being secured.

Although not part of the present invention, FIGS. 1 through 4 also show an integrally molded foxing tape 16 which may have three-dimensional figures **16*a* thereon, as can best be seen in FIGS. 1 and 2**.

In the following, the article of footwear according to the present invention will be described by way of an exemplary, preferred method of making the same, with reference to FIGS. 6 through 8 that illustrates certain consecutive operational phases thereof, noting however that the constituent parts are shown "exploded" in FIG. 2, in an assembled or united section in both FIGS. 3 and 4, and in plan views of FIGS. 1 and 5.

FIG. 5 merely constitutes a modification in that a substantially rectangular area is provided within the recess **14*a* of the sole 14, for the application of an inset 14*b* that, in this example, has straight edges rather than varying curved outlines as in FIG. 1. The sole is shown here with an optional treaded area 14*c***.

It should also be noted that the inset **14*b* shown in FIG. 1** consists, as a matter of example, of two portions, of a "figure" and of a "word" or "text", both being optional, so that any combination thereof can be used on a particular sole, limited only by the overall area that is available on the sole of a particular sneaker, sport shoe and the like.

A further optional detail is constituted by one or more peripheral ridges such as shown at **14*d*, which may closely surround the inset 14*b* (see FIG. 4) and/or run along the outlines of the sole 14, as identified in FIGS. 2 and 3**.

Figure 6:
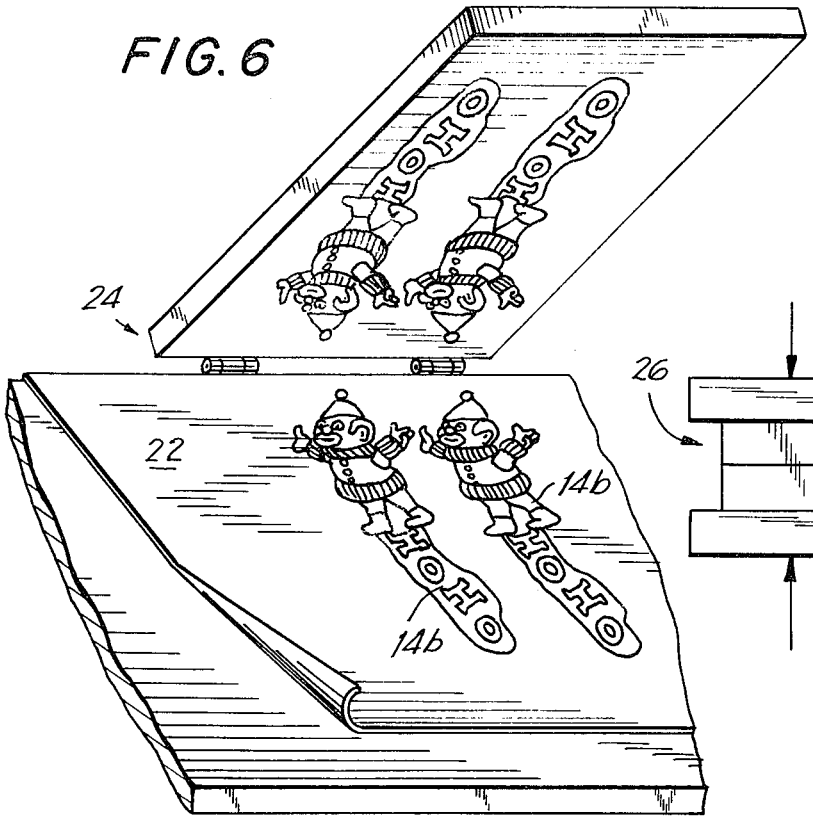

FIG. 6 illustrates a step of a preferred method of making the novel article of footwear, wherein an approx. 1 millimeter thick, preferably white or colorless non-vulcanized rubber sheet 22 is placed in a suitable mechanism 24, for example one having a hinged top portion, suitable for applying to the rubber sheet two or more representations (figures and/or words) such as exemplified at **14*b* (see also in FIGS. 1 and 2**). This step can be performed with the well known silk-screen method, by printing, or any other conventional method of transferring a pattern or representation to a flat rubber sheet and the like. Colors may optionally be used.

the printed sheet or sheets 22 are vulcanized or otherwise heated to make the printing (and color, if any) adhere thereto in a permanent manner. This can be done in a conventional oven or other implement (not shown).

Figure 7:
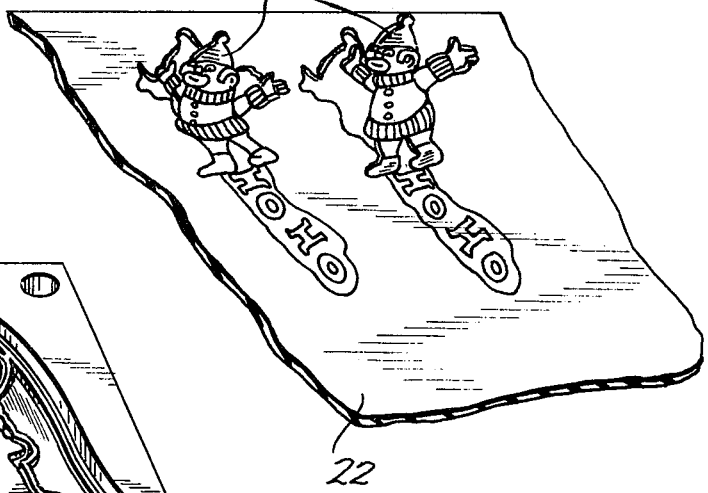

FIG. 7 shows the sheet 22 removed from the mechanism 22 of FIG. 6, and the representations **14*b* (figures and/or words) being cut out, punched or otherwise separated from the continuous sheet for subsequent individual usage. One or more of these insets 14*b* can be used for a single footwear, depending on the design to be applied to its sole (see FIG. 1**).

If a press or punch mechanism is used for cutting, several insets **14*b* may be lifted off with a single operation from a sheet 22** which has several of them printed over a large area, e.g. in an interleaved, space-saving pattern.

Figure 8:
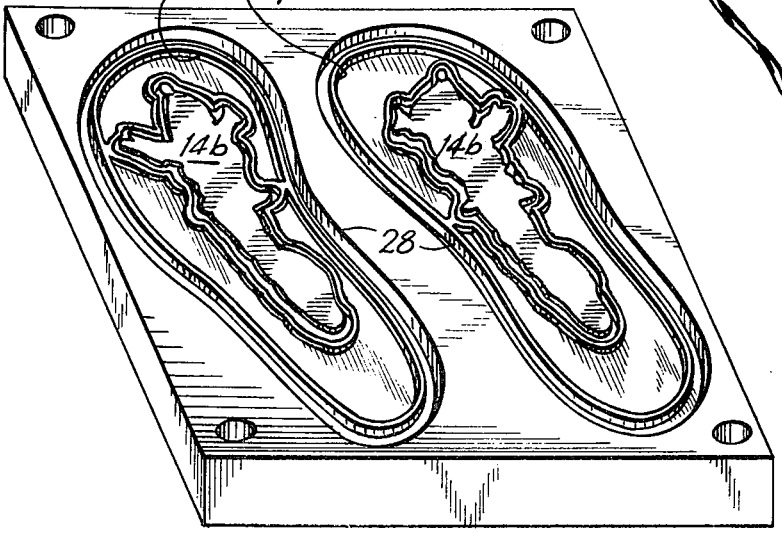

FIG. 8 schematically shows an iron mold 26 adapted to receive two previously made sole preforms 28 which will eventually become the sole portions 14, as was shown in FIG. 2 and elsewhere. Into each preform, one of the insets **14*b* is placed, the mold closed, and the parts permanently united, such as by the application of heat. The preforms may have the ridges therein that are shown at 14*d* for the sole 14** of the completed footwear.

It should be noted that the preforms 28 have recesses **28*a* therein that will become the recessed areas 14*a* of the soles 14, just slightly deeper than the thickness of the rubber sheet 22 from which the insets 14*b* were made, so that the latter do not protrude beyond the top edges of the preforms (as they are placed into the mold 26**).

Figure 9:
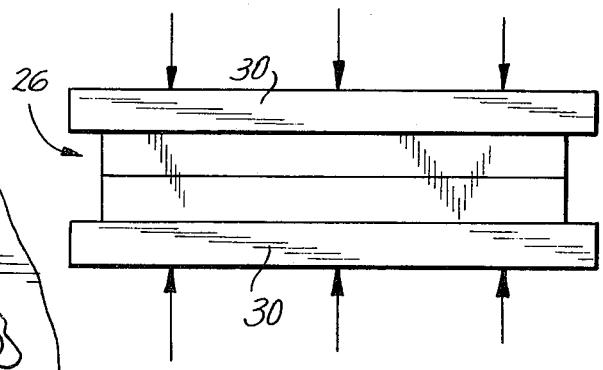

In FIG. 9, a pair of the molds 26 of FIG. 8 is shown being compressed between suitable boards 30 and the like, e.g. in a press, with or without the application of heat. This unites the insets with the sole preforms, while a similar molding and compressing operation is subsequently applied in a shoe machine (not shown) where an upper of a previously completed footwear 10 is eventually molded into one with the completed sole preform.

Referring to FIG. 2, the inset **14*b* (at the very bottom) is the result of the steps shown in FIGS. 6 and 7; the sole 14 with its recess 14*a*, and possibly with one or more ridges 14*d* (second from the bottom) comes from the preforms processed according to FIGS. 8 and 9; and the upper 12** is subsequently added, as explained, in the final step of securing each sole preform with its inset to the completed footwear.

While there has been shown what is considered to be the preferred embodiment of the invention, and a preferred manner of making the same, it will be obvious that modifications may be made which come within the scope of the disclosure of the specification.

What I claim is:

1. An article of footwear including a sole having a walking surface, an upper, and having at least one recessed area in said sole, comprising three-dimensional inset figure secured in said recessed area, which figure is at least partly embossed with an overlay illustration on the exposed surface of said inset figure, said exposed surface being substantially flush with said walking surface, said inset figure being adapted to leave an imprint of said illustration when the wearer walks on soft ground, wherein said inset figure is slightly smaller in its outlines than those of said recessed area of the sole, thereby presenting a peripheral ridge about said recessed area that limits a set-off border in said sole and around said inset figure, which border makes for a secure, non-slip grip during walking even when said sole is wet.

* * * * *